US011402103B2

(12) United States Patent
Chapman, Jr.

(10) Patent No.: US 11,402,103 B2
(45) Date of Patent: Aug. 2, 2022

(54) APPLIANCE USER INTERFACE WITH INCREASED CONTROL SETTINGS

(71) Applicant: Haier US Appliance Solutions, Inc., Wilmington, DE (US)

(72) Inventor: John Gilman Chapman, Jr., Louisville, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 576 days.

(21) Appl. No.: 16/161,738

(22) Filed: Oct. 16, 2018

(65) Prior Publication Data

US 2020/0116361 A1 Apr. 16, 2020

(51) Int. Cl.

| | |
|---|---|
| ***F24C 7/08*** | (2006.01) |
| ***H05B 6/06*** | (2006.01) |
| ***H05B 1/02*** | (2006.01) |

(52) U.S. Cl.

CPC ..... *F24C 7/086* (2013.01); *F24C 7/081* (2013.01); *H05B 1/0266* (2013.01); *H05B 6/062* (2013.01); *H05B 2213/07* (2013.01)

(58) Field of Classification Search

CPC ..... F24C 7/086; F24C 7/081; H05B 1/02; H05B 1/0266; H05B 1/0258; H05B 6/062; H05B 2213/07

USPC ..... 219/508, 507, 294, 443.1, 412–414, 518

See application file for complete search history.

(56) References Cited

U.S. PATENT DOCUMENTS

| | | | | |
|---|---|---|---|---|
| 6,570,139 | B1 * | 5/2003 | Levy | G05D 23/1909 219/483 |
| 7,105,779 | B2 | 9/2006 | Shei | |
| 9,486,109 | B2 * | 11/2016 | Clothier | A47J 36/027 |
| 9,618,210 | B2 | 4/2017 | Lee et al. | |
| 9,648,668 | B2 | 5/2017 | Stella et al. | |
| 2004/0256378 | A1 | 12/2004 | Shukla | |
| 2008/0110875 | A1 | 5/2008 | Fisher | |
| 2013/0056457 | A1 | 3/2013 | Lee et al. | |
| 2014/0374402 | A1 * | 12/2014 | Cornelius | A61F 9/028 219/211 |
| 2016/0196109 | A1 * | 7/2016 | Wait | H05B 1/0266 219/445.1 |
| 2017/0238749 | A1 * | 8/2017 | Vengroff | A47J 36/00 |
| 2017/0245327 | A1 * | 8/2017 | Viroli | H05B 6/062 |
| 2017/0292712 | A1 * | 10/2017 | Alexander | G06F 3/04883 |

(Continued)

FOREIGN PATENT DOCUMENTS

EP 0729292 A1 8/1996

*Primary Examiner* — Justin C Dodson

(74) *Attorney, Agent, or Firm* — Dority & Manning, P.A.

(57) ABSTRACT

A method for adjusting an appliance heating element power level includes adjusting a heating element to a first power level in response to actuation of a user input to a first level setting and adjusting the heating element from the first power level to a second power level in response to actuation of the user input to a second level setting. The second power level of the heating element is different than the first power level of the heating element, and the second level setting is next to the first level setting within a power level setting sequence. The method also includes adjusting the heating element from the second power level to a third power level in response to actuation of the user input back to the first level setting. The third power level of the heating element is between the first and second power levels of the heating element.

17 Claims, 2 Drawing Sheets

(56) References Cited

U.S. PATENT DOCUMENTS

| | | | | |
|---|---|---|---|---|
| 2018/0010805 | A1* | 1/2018 | Bach | F24C 7/087 |
| 2018/0128493 | A1* | 5/2018 | Chen | H05B 3/746 |

* cited by examiner

| Previous Action | Level | Display | Action | New Level | New Display |
|---|---|---|---|---|---|
| - | 4 | 4 | + | 5 | 5 |
| + | 5 | 5 | - | 4.5 | 4 |
| - | 4.5 | 4 | - | 3 | 3 |

FIG. 3

| Previous Action | Level | Display | Action | New Level | New Display |
|---|---|---|---|---|---|
| - | 4 | 4 | + | 5 | 5 |
| + | 5 | 5 | - | 4.5 | 4 |
| - | 4.5 | 4 | + | 4.75 | 5 |
| + | 4.75 | 5 | - | 4.625 | 4 |
| - | 4.625 | 4 | - | 3 | 3 |

FIG. 4

| Previous Action | Level | Display | Action | New Level | New Display |
|---|---|---|---|---|---|
| + | 6 | 6 | - | 5 | 5 |
| - | 5 | 5 | + | 5.5 | 6 |
| + | 5.5 | 6 | + | 7 | 7 |

FIG. 5

| Previous Action | Level | Display | Action | New Level | New Display |
|---|---|---|---|---|---|
| + | 6 | 6 | - | 5 | 5 |
| - | 5 | 5 | + | 5.5 | 6 |
| + | 5.5 | 6 | - | 5.25 | 5 |
| - | 5.25 | 5 | - | 4 | 4 |

FIG. 6

APPLIANCE USER INTERFACE WITH INCREASED CONTROL SETTINGS

FIELD OF THE INVENTION

The present subject matter relates generally to user interfaces for appliances.

BACKGROUND OF THE INVENTION

Appliances generally include a user interface which is operable to input control commands. For example, the user interface on an induction cooking appliances is operable to adjust a heat setting of an induction heating element. In particular, a user may increase the induction heating element's current heat setting using one button on the user interface, and the user may decrease the induction heating element's current heat setting using another button on the user interface.

Current user interfaces on induction cooking appliances have drawbacks. In particular, in certain induction cooking appliances, a user is limited to heat settings with whole number values between "1" and "10", with "1" corresponding to the lowest heat setting and "10" corresponding to the highest heat setting. Thus, such induction cooking appliances generally provide only ten discrete heat settings. However, induction heating elements are generally operable at significantly more than ten heat settings.

The predetermined, discrete heat settings in known appliances work can provide non-optimal heating for certain items, such as sauces. To provide proper heating, a user may frequently toggle the heat setting up and down to obtain suitable heating of such items. For example, the user may toggle the user interface between the "4" heat setting, which results in no bubbles for a simmer, and a "5" heat setting, which results in an overly rapid simmer. Such toggling can be inconvenient and tedious.

A known solution to providing suitable heating is a closed loop control with a temperature sensor. The closed loop control monitors heating of an item and adjusts a power output of the induction heating element based upon measurements from the temperature sensor. However, closed loop control is expensive.

BRIEF DESCRIPTION OF THE INVENTION

Aspects and advantages of the invention will be set forth in part in the following description, or may be apparent from the description, or may be learned through practice of the invention.

In a first example embodiment, a method for adjusting a power level of an appliance heating element includes adjusting a heating element to a first power level in response to actuation of a user input to a first level setting and adjusting the heating element from the first power level to a second power level in response to actuation of the user input to a second level setting. The second power level of the heating element is different than the first power level of the heating element, and the second level setting is next to the first level setting within a power level setting sequence, The method also includes adjusting the heating element from the second power level to a third power level in response to actuation of the user input back to the first level setting. The third power level of the heating element is between the first and second power levels of the heating element.

In a second example embodiment, a method for adjusting a power level of an appliance heating element includes toggling a user input between a first number and a second number one or more times. After toggling the user input between the first and second numbers, the method includes adjusting a heating element to a first power level in response to actuation of the user input to the first number. The method further includes adjusting the heating element from the first power level to a second power level in response to actuation of the user input to the second number. The second power level of the heating element is different than the first power level of the heating element, and the second number is next to the first number within a power setting number sequence. The method also includes adjusting the heating element from the second power level to a third power level in response to actuation of the user input back to the first number. The third power level of the heating element is between the first and second power levels of the heating element. The power level setting sequence includes no more than eleven level settings.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIGS. 3 through 6 illustrate various tables of power level adjustments during a method according to an example embodiment of the present subject matter.

DETAILED DESCRIPTION

Figure 1:
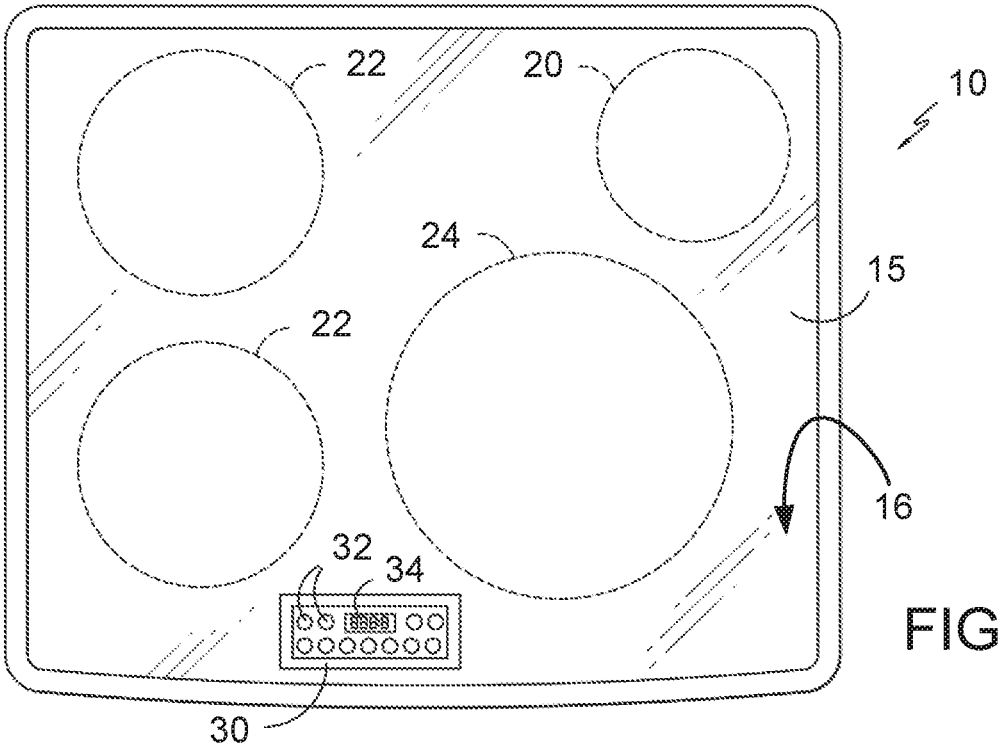
FIG. 1 is a top, plan view of a cooktop appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a top, plan view of a cooktop appliance 10 according to an exemplary embodiment of the present subject matter. Cooktop appliance 10 can be installed in various locations such as in cabinetry in a kitchen, with one or more ovens to form a range appliance, or as a standalone appliance. Thus, as used herein, the term "cooktop appliance" includes grill appliances, stove appliances, range appliances, and other appliances that incorporate cooktops.

Cooktop appliance 10 includes a ceramic plate 15 for supporting cooking utensils, such as pots or pans, on a cooking or top surface 16 of ceramic plate 15. Ceramic plate 15 may be any suitable ceramic or glass plate. Induction heating elements 20, 22 and 24 are mounted below ceramic plate 15 such that heating elements 20, 22 and 24 are positioned below ceramic plate 15, e.g., along a vertical direction V (FIG. 3).

While shown with four heating elements 20, 22 and 24 in the exemplary embodiment of FIG. 1, cooktop appliance 10 may include any number of heating elements 20, 22 and 24 in alternative exemplary embodiments. Heating elements 20, 22 and 24 can also have various diameters. For example, each heating element of heating elements 20, 22 and 24 can have a different diameter, the same diameter, or any suitable combination thereof. Cooktop appliance 10 is provided by way of example only and is not limited to the exemplary embodiment shown in FIG. 1. For example, a cooktop appliance having one or more induction heating elements in combination with one or more radiant, electric resistance or gas burner heating elements can be provided. In addition, various combinations of number of heating elements, position of heating elements and/or size of heating elements can be provided.

A user interface 30 provides visual information to a user and allows a user to select various options for the operation of cooktop appliance 10. For example, displayed options can include a desired heating elements 20, 22 and 24, a desired cooking temperature, and/or other options. User interface 30 can be any type of input device and can have any configuration. In FIG. 1, user interface 30 is located within a portion of ceramic plate 15. Alternatively, user interface 30 can be positioned on a vertical surface near a front side of cooktop appliance 10 or anywhere convenient for a user to access during operation of cooktop appliance 10.

In the exemplary embodiment shown in FIG. 1, user interface 30 includes a capacitive touch screen input device component 32. Capacitive touch screen input device component 32 can allow for the selective activation, adjustment or control of any or all heating elements 20, 22 and 24 as well as any timer features or other user adjustable inputs. One or more of a variety of electrical, mechanical or electro-mechanical input devices including rotary dials, push buttons, toggle/rocker switches, and/or touch pads can also be used singularly or in combination with capacitive touch screen input device component 32. User interface 30 also includes a display component 34, such as a digital or analog display device designed to provide operational feedback to a user.

Figure 2:
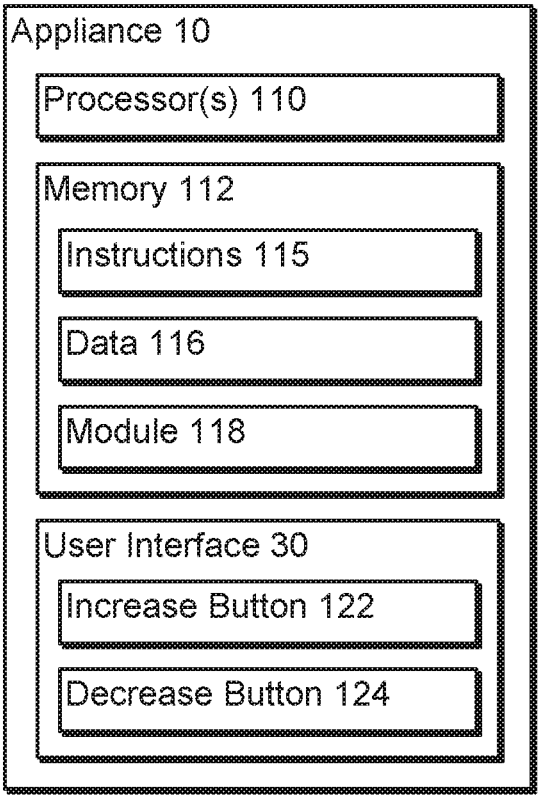
FIG. 2 is a schematic view of certain components of the example cooktop appliance of FIG. 1.

Turning to FIG. 2, cooktop appliance 10 also includes one or more processors 110 and a memory 112. The processor(s) 110 of cooktop appliance 10 can be any suitable processing device, such as a microprocessor, microcontroller, integrated circuit, or other suitable processing device. The memory 112 of cooktop appliance 10 can include any suitable computing system or media, including, but not limited to, non-transitory computer-readable media, RAM, ROM, hard drives, flash drives, or other memory devices. The memory 112 of cooktop appliance 10 can store information accessible by processor(s) 110 of cooktop appliance 10, including instructions 115 that can be executed by processor(s) 110 to control various components of cooktop appliance 10 to provide appliance functionality and data 116. Thus, the combination of one or more processors 110 and memory 112 may correspond to a controller configured to implement various programs or methods to operate cooktop appliance 10, and processors 110 and memory 112 may be collectively referred to herein as a controller 109. Input/output ("I/O") signals may be routed between controller 109 and various operational components of cooktop appliance 10 along wiring harnesses that may be routed within cooktop appliance 10.

A module 118 is included or stored in memory 112 of cooktop appliance 10. It will be appreciated that the term "module" refers to computer logic utilized to provide desired functionality. Thus, a module can be implemented in hardware, application specific circuits, firmware and/or software controlling a general purpose processor. In one embodiment, modules are program code files stored on the storage device, loaded into memory and executed by a processor or can be provided from computer program products, for example computer executable instructions, that are stored in a tangible computer-readable storage medium such as RAM, hard disk or optical or magnetic media. Thus, while module 118 is shown stored in memory 112 of cooktop appliance 10 in the example embodiment shown in FIG. 1, module 118 may be stored in or implemented by any other suitable component of cooktop appliance 10 in alternative example embodiments.

As noted above, various appliance features of cooktop appliance 10 may be activated, deactivated and/or adjusted by a user manipulating the input components on user interface 30. Thus, e.g., a user of cooktop appliance 10 may manipulate buttons on user interface 30 to activate, deactivate and/or adjust one or more of heating elements 20, 22 and 24. In particular, the user of cooktop appliance 10 may increase a power output of one or more of heating elements 20, 22 and 24 with a power increase button 122, and the user of cooktop appliance 10 may decrease the power output of one or more of heating elements 20, 22 and 24 with a power decrease button 124.

An example method for adjusting a power level of a heating element of appliance 10 will now be described. In particular, such method is described in greater detail below in the context of heating element 20 for the sake of brevity. However, it will be understood that such method may be used with any one or combination of heating elements 20, 22 and 24 in alternative example embodiments. In addition, it will be understood that while discussed below in a certain sequence, the method may be performed in other suitable sequences in alternative example embodiments. Thus, the method is not limited to the particular sequence described below.

The method described below may allow operation of heating element 20 at more power outputs than display component 34 is configured to present. For example, display component 34 may be a seven-segment display or liquid crystal display that is operable or programmed to display a series of numbers. Each of the series of numbers may correspond to a respective power output of heating element 20. In particular, the series of numbers may be between one (1) and nine (9), with one (1) corresponding to the lowest power output of heating element 20, ten (10) corresponding to the lowest power output of heating element 20 and each of the numbers between one (1) and ten (10) corresponding to a power output between the lowest and highest power outputs and increasing from two (2) to eight (8). Thus, the method described below may allow operation of heating element 20 at more power levels than the ten numbers that display component 34 is configured to present.

As another example, display component 34 may be a series or ring of light emitters, such as light emitting diodes. The number of active light emitters may correspond to the power output of heating element 20. In particular, display component 34 may activate one of the light emitters at the lowest power output of heating element 20, all of the light emitters at the highest power output of heating element 20 and each of the number of active light emitters between one and all of the light emitters corresponding to a power output between the lowest and highest power outputs and increasing from two (2) light emitters to one less than all of the light emitters. Thus, the method described below may allow operation of heating element 20 at more power levels than the number of light emitters in the series or ring of light emitters.

As may be seen from the above, example aspects of the present subject matter allow increased power level settings for an appliance despite a display of the appliance having limited level setting displays. In particular, display component 34 may provide a small number of level setting for display relative to a number of power levels at which heating element 20 is operable. For example, heating element 20 may be operable at more than one hundred (100) power levels, and display component 34 may be operable to present no more than twenty level settings (e.g., when display component 34 is the series or ring of light emitters), no more than eleven level settings (e.g., when display component 34 is the seven-segment or liquid crystal display), etc. Thus, heating element 20 may have more of an infinite feel enabling better control of cooking products.

To initiate the fine control, a user may toggle user input 30 one or more times between a first level setting and a second level setting. The second level setting is next to the first level setting within a power level setting sequence. The power level setting sequence may correspond to the series of numbers and/or the activated light emitters in the series or ring of light emitters described above. Thus, the current power level setting selected on user input 30 and presented on display component 34 may communicate an expected power output of heating element 20 to the user. For example, the user may expect heating element 20 to have a low power output when a low power level setting in the power level setting sequence is presented on display component 34. Conversely, the user may expect heating element 20 to have a high power output when a high power level setting in the power level setting sequence is presented on display component 34.

As noted above, the second level setting is next to the first level setting within the power level setting sequence. Thus, the user may toggle user input 30 one or more times between two, adjacent level settings within the power level setting sequence. When user input 30 is adjusted to the first level setting, controller 109 operates heating element 20 at a first power level. Conversely, controller 109 operates heating element 20 at a second power level when user input 30 is adjusted to the second level setting. The first power level of heating element 20 is different (e.g., greater or less) than the second power level of heating element 20.

The user toggling user input 30 between the first and second level settings may be indicative of the first and second power levels being unsuited for a desired cooking operation. For example, the first power level may be too low while the second power level is too high or vice versa. Thus, controller 109 may adjust the power level at which heating element 20 operates in response to the user toggling user input 30 between the first and second level settings as discussed in greater detail below.

During the toggling, controller 109 may adjust heating element 20 (e.g., from the second power level) to the first power level in response to actuation of user input 30 to the first level setting. Display component 34 may also show the first power level in response to actuation of user input 30 to the first level setting. Next, controller 109 may adjust heating element 20 from the first power level to the second power level in response to actuation of user input 30 to the second level setting. In addition, display component 34 may show the second power level in response to actuation of user input 30 to the second level setting.

Controller 109 may next adjust heating element 20 from the second power level to a third power level in response to actuation of user input 30 back to the first level setting. The third power level of heating element 20 is between the first and second power levels of the heating element. As an example, the third power level may be about an average of the first and second power levels. As used herein, the term "about" means within ten percent of the stated value when used in the context of average values.

As may be seen from the above, controller 109 shifts heating element 20 to the third power level rather than the first power level to provide finer control of the power output of heating element 20. However, display component 34 shows the first power level in response to actuation of user input 30 back to the first level setting and while heating element 20 is operating at the third power level. Thus, the fine control provided by the present subject matter may not be communicated to the user of cooking appliance 10, e.g., due to the limited display options provided by display component 34.

Additional fine control may be provided as the user continues to toggle between the first and second level settings. For example, controller 109 may adjust heating element 20 from the third power level to a fourth power level in response to actuation of user input 30 back to the second level setting, and display component 34 may show the second power level in response to actuation of user input 30 back to the second level setting and while heating element 20 is operating at the fourth power level. The fourth power level of heating element 202 is between the second and third power levels of heating element 20. As an example, the fourth power level may be about an average of the second and third power levels. The above described process may be repeated to achieve suitable fine control.

Example implementations of the above described method will now be described in the context of the tables in FIGS. 3 through 6. As shown in FIG. 3, controller 109 may operate heating element 109 at a four ("4") power level, and display component 34 may present a four ("4") power level setting to the user. Controller 109 may increase the power level of heating element 20 from the four power level to a five ("5") power level in response to user actuation of the power increase button 122 on user interface 30 to a five ("5") power level setting, and display component 34 may present the five power level setting to the user. Next, the user may toggle user interface 30 back to the four power level setting with power decrease button 124, and controller 109 may decrease the power level of heating element 20 from the five power level to a four and a half ("4.5") power level, e.g., between the four and five power levels. However, display component 34 may present the four power level setting to the user. As may be seen from the above, fine control of the power output of heating element 20 may be provided in response to toggling between two power level settings on user interface.

The fine control provided in response to the user toggling user input 30 between the four and five power level settings may be stopped when the user actuates the user input 30 twice in the same direction along the power level setting sequence. For example, as shown in FIG. 3, controller 109 may decrease heating element 20 from the four and a half power level to a three ("3") power level in response to another user actuation of the power decrease button 124 on user interface 30 to a three ("3") power level setting, and display component 34 may present the three power level setting to the user. In alternative example embodiments, the fine control may be terminated after a suitable elapsed time (e.g., five minutes, ten minutes, etc.) without additional actuation of user input 30. After a suitable elapsed time, it may be assumed that further fine control is not required.

Turning to FIG. 4, the example method is the same as shown in FIG. 3 with additional fine control. In particular, rather than immediately exiting the fine control from the four and a half power level, the user may toggle user interface 30 back to the five power level setting with power increase button 122, and controller 109 may increase the power level of heating element 20 from the four and a half power level to a four and three-quarters ("4.75") power level. However, display component 34 may present the five power level setting to the user. Further, the user may toggle user interface 30 back to the four power level setting with power decrease button 124, and controller 109 may decrease the power level of heating element 20 from the four and three-quarters power level to a four and five-eights ("4.625") power level. However, display component 34 may present the four power level setting to the user. To exit the fine control, the user actuates the power decrease button 124 on user interface 30 to the three power level setting.

As shown in FIG. 5, controller 109 may operate heating element 109 at a six ("6") power level, and display component 34 may present a six ("6") power level setting to the user, e.g., in response to a user actuating the power increase button 122. Controller 109 may decrease the power level of heating element 20 from the six power level to the five power level in response to user actuation of the power increase button 122 on user interface 30 to the five power level setting, and display component 34 may present the five power level setting to the user. Next, the user may toggle user interface 30 back to the six power level setting with power decrease button 124, and controller 109 may increase the power level of heating element 20 from the five power level to a five and a half ("5.5") power level, e.g., between the five and six power levels. However, display component 34 may present the six power level setting to the user. As may be seen from the above, the fine control of the power output of heating element 20 may be provided in both a decreasing direction (FIGS. 3 and 4) and an increasing direction (FIGS. 5 and 6).

The fine control provided in response to the user toggling user input 30 between the five and six power level settings may be stopped when the user actuates the user input 30 twice in the same direction along the power level setting sequence. For example, as shown in FIG. 5, controller 109 may increase heating element 20 from the five and a half power level to a seven ("7") power level in response to another user actuation of the power increase button 122 on user interface 30 to a seven ("7") power level setting, and display component 34 may present the seven power level setting to the user.

Turning to FIG. 6, the example method is the same as shown in FIG. 5 with additional fine control. In particular, rather than immediately exiting the fine control from the four and a half power level, the user may toggle user interface 30 back to the five power level setting with power decrease button 124, and controller 109 may decrease the power level of heating element 20 from the five and a half power level to a five and a quarter ("5.25") power level. However, display component 34 may present the five power level setting to the user. To exit the fine control, the user actuates the power decrease button 124 on user interface 30 to the four power level setting.

As may be seen from the above, the present subject matter provides a user interface that enables a display with fixed settings (e.g., zero through nine numbers or nineteen LEDs) to have more of an infinite feel. In particular, the present subject matter permits cooking appliance 10 to monitor user interaction with user interface 30 and extrapolate a better power level for heating element. When the user toggles between two levels, then the power level of the heating element is adjusted to a level between the two toggled levels. When the user continues to toggle between the two levels, the adjusted power level is honed in to a finer level. Despite such fine control, display component 34 only presents the two integer levels. In such a manner, cooking appliance 10 may provide better control of heating element 20 relative to known cooking appliances without a complex display that can be tedious to use or complex to understand.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for adjusting a power level of an appliance heating element, comprising:

adjusting a heating element to a first power level and showing the first level setting on a display in response to actuation of a user input to a first level setting;

adjusting the heating element from the first power level to a second power level and showing the second level setting on the display in response to actuation of the user input to a second level setting, the second power level of the heating element being different than the first power level of the heating element, the second level setting being next to the first level setting within a power level setting sequence; and adjusting the heating element from the second power level to a third power level and showing the first level setting on the display in response to toggling back to the first level setting by a subsequent actuation of the user input the first level setting, the third power level of the heating element being between the first and second power levels of the heating element, wherein the third power level is about an average of the first power level and the second power level.

2. The method of claim 1, further comprising adjusting the heating element from the third power level to a fourth power level and showing the second level setting on the display in response to toggling back to the second level setting by a subsequent actuation of the user input back to the second level setting, the fourth power level of the heating element being between the first and third power levels of the heating element or between the second and third power levels of the heating element, wherein the fourth power level is about an average of the first power level and the third power level or the fourth power level is about an average of the second power level and the third power level, respectively.

3. The method of claim 1, wherein adjusting the heating element to the first power level comprises adjusting the heating element from the second power level to the first power level.

4. The method of claim 1, wherein:

adjusting the heating element to the first power level comprises decreasing a power output of the heating element to the first power level in response to actuation of the user input to the first level setting;

adjusting the heating element from the first power level to the second power level comprises increasing the power output of the heating element from the first power level to the second power level in response to actuation of the user input to the second level setting; and adjusting the heating element from the second power level to the third power level comprises decreasing the power output of the heating element from the second power level to the third power level in response to actuation of the user input back to the first level setting.

5. The method of claim 4, wherein:

the user interface comprises a power level increase button and a power level decrease button;

decreasing the power output of the heating element to the first power level comprises decreasing the power output of the heating element to the first power level in response to actuation of the power level decrease button on the user input; and increasing the power output of the heating element from the first power level to the second power level comprises increasing the power output of the heating element from the first power level to the second power level in response to actuation of the power level increase button on the user input; and decreasing the power output of the heating element from the second power level to the third power level comprises decreasing the power output of the heating element the second power level to the third power level in response to actuation of the power level decrease button on the user input.

6. The method of claim 5, further comprising decreasing the power output of the heating element from the third power level to a fourth power level in response to another actuation of the power level decrease button on the user input, the fourth level setting being less than the third power level setting, wherein the fourth power level is about an average of the first power level and the third power level.

7. The method of claim 1, wherein:

adjusting the heating element to the first power level comprises increasing a power output of the heating element to the first power level in response to actuation of the user input to the first level setting;

adjusting the heating element from the first power level to the second power level comprises decreasing the power output of the heating element from the first power level to the second power level in response to actuation of the user input to the second level setting; and adjusting the heating element from the second power level to the third power level comprises increasing the power output of the heating element from the second power level to the third power level in response to actuation of the user input back to the first level setting, wherein the third power level is about an average of the first power level and the second power level.

8. The method of claim 7, wherein:

the user interface comprises a power level increase button and a power level decrease button;

increasing the power output of the heating element to the first power level comprises increasing the power output of the heating element to the first power level in response to actuation of the power level increase button on the user input; and decreasing the power output of the heating element from the first power level to the second power level comprises decreasing the power output of the heating element from the first power level to the second power level in response to actuation of the power level decrease button on the user input; and increasing the power output of the heating element from the second power level to the third power level comprises increasing the power output of the heating element the second power level to the third power level in response to actuation of the power level increase button on the user input.

9. The method of claim 8, further comprising increasing the power output of the heating element from the third power level to a fourth power level in response to another actuation of the power level increase button on the user input, the fourth level setting being greater than the third power level setting, wherein the fourth power level is about an average of the first power level and the third power level.

10. The method of claim 1, wherein the power level setting sequence comprises no more than twenty level settings.

11. The method of claim 10, wherein the power level setting sequence comprises no more than eleven level settings.

12. The method of claim 1, wherein the heating element is an induction heating element.

13. The method of claim 1, wherein the user input is toggled between the first and second level settings one or more times prior to adjusting the heating element from the second power level to the third power level.

14. A method for adjusting a power level of an appliance heating element, comprising:

adjusting a heating element to a first power level and showing a first number on a display in response to actuation of a user input to the first number;

adjusting the heating element from the first power level to a second power level and showing a second number on the display in response to actuation of the user input to a second number, the second power level of the heating element being different than the first power level of the heating element, the second number being next to the first number within a power setting number sequence; and adjusting the heating element from the second power level to a third power level and showing the first number on the display in response to toggling back to the first number by a subsequent actuation of the user input back to the first number, the third power level of the heating element being between the first and second power levels of the heating element, wherein the third power level is about an average of the first power level and the second power level, and wherein the power level setting sequence comprises no more than eleven level settings.

15. The method of claim 14, further comprising adjusting the heating element from the third power level to a fourth power level and showing the second number on the display in response to toggling back to the second number by a subsequent actuation of the user input back to the second number, the fourth power level of the heating element being between the first and third power levels of the heating element or between the second and third power levels of the heating element, wherein the fourth power level is about an average of the first power level and the third power level or the fourth power level is about an average of the second power level and the third power level, respectively.

16. The method of claim 14, wherein adjusting the heating element to the first power level comprises adjusting the heating element from the second power level to the first power level.

17. The method of claim 14, wherein the heating element is an induction heating element.

* * * * *